United States Patent [19]

Hair et al.

[11] Patent Number: 5,052,441

[45] Date of Patent: Oct. 1, 1991

[54] DIRECT DRIVE SERVOVALVE HAVING BEARING-LOCATED MOTOR HOUSING

[75] Inventors: Kenneth Hair, Valencia; Kenneth Laux, Newhall, both of Calif.

[73] Assignee: HR Textron Inc., Valencia, Calif.

[21] Appl. No.: 589,127

[22] Filed: Sep. 27, 1990

[51] Int. Cl.[5] ..... F15B 13/044

[52] U.S. Cl. ..... 137/625.65; 251/129.11

[58] Field of Search ..... 137/625.65; 251/129.11

[56] References Cited

U.S. PATENT DOCUMENTS 4,793,377 12/1988 Haynes et al. ..... 137/628.65

*Primary Examiner*—Gerald A. Michalsky

*Attorney, Agent, or Firm*—Nilsson, Robbins, Dalgarn, Berliner, Carson & Wurst

[57] ABSTRACT

A direct drive servovalve wherein rotational motion of a drive motor rotor is converted into linear motion of a spool valve. The drive motor is mounted upon the valve housing through utilization of the outer surface of a bearing which supports the rotor shaft of the drive motor. The bearing fits within a recess provided in the surface of the housing and protrudes above the housing to be received within an additional recess defined within the drive motor.

3 Claims, 1 Drawing Sheet

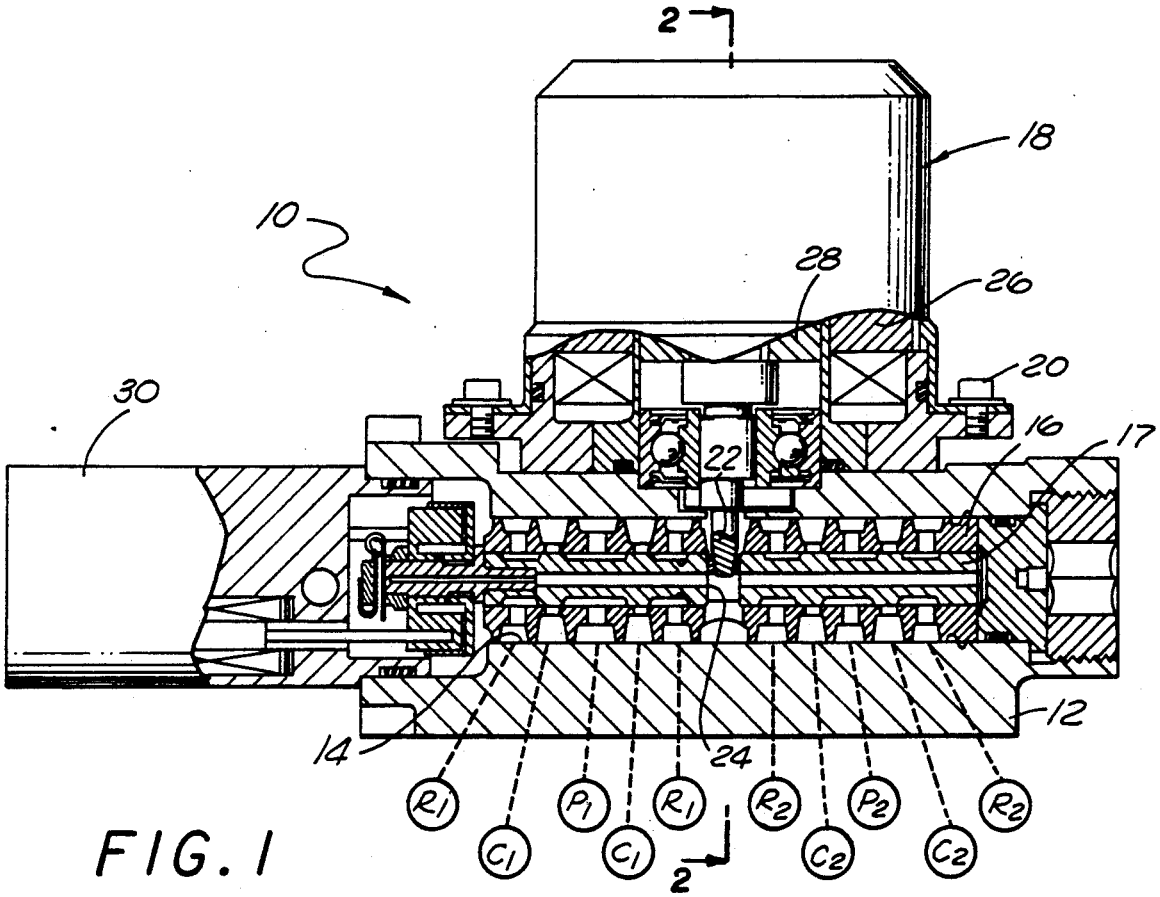
FIG. 1
FIG. 2
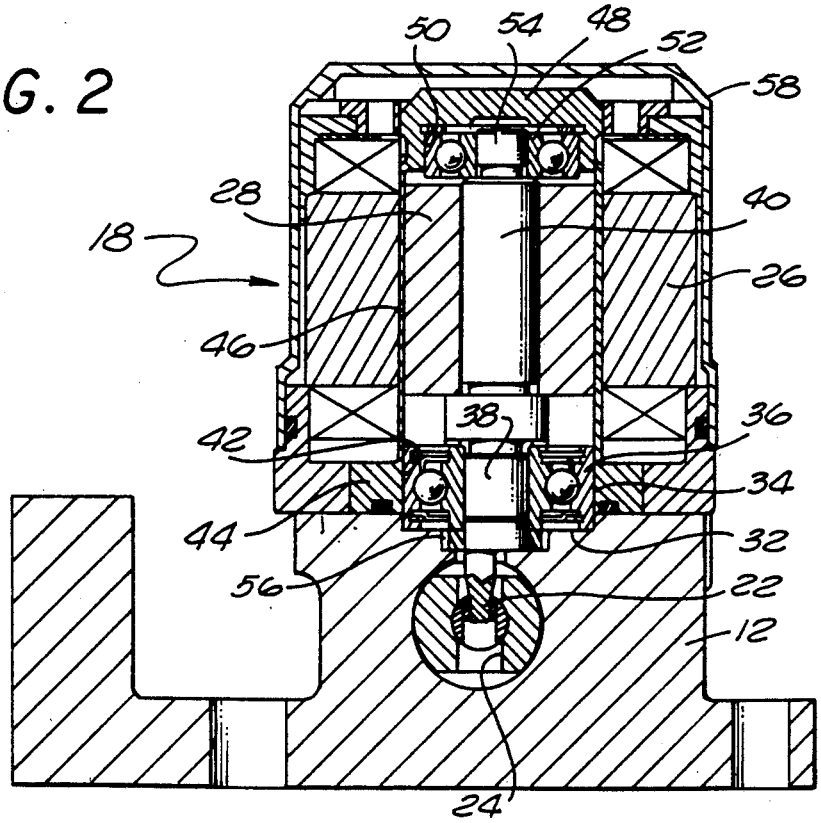

DIRECT DRIVE SERVOVALVE HAVING BEARING-LOCATED MOTOR HOUSING

FIELD OF THE INVENTION

This invention relates to direct drive servovalves and more particularly to a direct drive servovalve in which rotational motion of a motor rotor is converted into linear motion of a spool valve wherein the drive motor is located upon the value housing through utilization of a bearing.

BACKGROUND OF THE INVENTION

Torque motor-driven spool valves are well known in the art including such which operate through the utilization of a rotary torque motor having a drive member extending from the rotor thereof into contact with the spool valve to directly reciprocate the spool valve within a bore provided in the valve housing to thereby control the flow of fluid from a source thereof to the load in response to electrical signals applied to the drive motor. Typical of such direct drive servovalves is that illustrated in U.S. Pat. No. 4,793,377 issued Dec. 27, 1988, to Larry E. Haynes et al. The invention described and claimed herein is an improvement over the direct drive servovalve disclosed in U.S. Pat. No. 4,793,377 and therefore the disclosure of U.S. Pat. No. 4,793,377 is incorporated herein by this reference.

Other prior art known to applicants are U.S. Pat. Nos. 4,197,474; 2,769,943; 2,697,016; 4,452,423; 4,339,737 and 4,702,123 as well as Canadian Patent 601,808 issued July 19, 1960, and United Kingdom Patent 1,521,668 issued Aug. 16, 1978.

It is critical in direct drive servovalves that the drive member of the drive motor be properly aligned with the spool valve to obtain the desired control of the flow of fluid by the spool valve. In prior-art valves, it has been traditional to hold strict tolerances with respect to bearing/housing concentricities, base/housing concentricities, flange mounting holes, as well as the rotor shaft and other components of the motor assembly in order to provide the correct alignments. The strict attention to these tolerances both during manufacture and assembly of the direct drive servovalves necessarily adds to the expense and difficulty of manufacture thereof. Furthermore, it becomes extremely difficult to disassemble such valves for repair and/or maintenance and then reassemble them while maintaining the desired alignments and tolerances.

SUMMARY OF THE INVENTION

In accordance with the present invention, there is provided a direct drive servovalve which includes a valve spool reciprocally mounted within a bore in a valve housing along with motor means including a drive member to engage the valve for movement within the bore to provide control over the flow of fluid through the value. The motor means is mounted upon the valve housing by utilization of the outer surface of a bearing means which supports the rotor shaft of the motor by appropriate interference fits and locational slip fits utilizing the outer surface of the bearing in conjunction with a recess defined within the valve housing.

BRIEF DESCRIPTION OF THE DRAWINGS

FIG. 1 is a longitudinal cross-sectional view of a direct drive servovalve constructed in accordance with the principles of the present invention; and FIG. 2 is a cross-sectional view taken about the lines 2—2 of FIG. 1.

DESCRIPTION OF THE ILLUSTRATIVE EMBODIMENT

By reference to FIG. 1, there is shown a direct drive valve 10 constructed in accordance with the principles of the present invention. As is therein shown, a valve housing 12 includes a bore 14 within which there is positioned a sleeve 16. A reciprocally movable spool valve 17 is mounted within the sleeve 16. A torque motor 18 is affixed to the housing 12 by means of bolts or other fasteners 20 so that a drive member 22 engages an opening 24 provided therefor in the spool 17 to move the spool 17 in response to electrical signals applied to the motor means 18 as is well known in the art.

As is illustrated in FIGS. 1 and 2, the motor means is a rotary motor including a stator 26 and a rotor 28 as is well known in the art.

As is shown particularly in FIG. 1, the direct drive servovalve constructed in accordance with the principles of the present invention includes appropriate ports for the control of fluid from dual sources thereof under pressure P1 and P2 to, for example, a dual tandem actuator (not shown) and from the actuator to return through the utilization of fual cylinder ports. Such is indicated by the designations P1, R1 and C1 as well as P2, R2 and C2. The valve assembly 10 may also include an LVDT 30 as is well known in the prior art. The construction of the rotary direct drive servovalve as illustrated in FIG. 1 and 2 and thus far described is well known in the prior art and additional detail with regard thereto is not believed to be necessary. Additional description will be given in detail directed to the specific details of the improvement of the present invention wherein the motor means 82 is located and mounted upon the valve housing 12 through utilization of a bearing means.

As is shown more particularly in FIG. 2, the valve housing 12 defines a first recess 32 which receives the outer surface 34 of a bearing means 36 mounted upon one end 38 of the rotor shaft 40 to the motor means 18. The recess 32 conforms to the outer surface 34 cross-sectional configuration of the bearing 36 and has a depth which is substantially less than the longitudinal length of the outer surface 34 of the bearing 36. As a result and as is clearly illustrated in FIG. 1 and 2, when the bearing is received within the recess 32, a substantial portion of the outer surface 34 thereof protrudes from the housing 12.

As a result of the longitudinal dimension of the outer surface 34 of the bearing 36, it can be seen from FIGS. 1 and 2 that the bearing is mutually received within a second recess 42 defined by the lower portion 44 of the isolation tube 46. The isolation tube 46 surrounds the rotor 28 of the motor means 18 and isolates hydraulic fluid from the stator portion 26 of the motor means 18.

The isolation tube 46 also includes as upper portion 48 thereof which defines a third recess 50 which receives a second bearing means 52. The bearing means 36 and 52 are utilized to support the rotor shaft 40 in a properly aligned position within the isolation tube 46. Such alignment is obtained by inserting the end 54 of the shaft 40 by way of an interference fit into the inner race of the bearing means 52. The outer race of the bearing means 52 is then inserted by means of a locational slip fit between the third recess 50 and the outer race of the bearing means 52. The bearing means 36 is inserted by means of an interference fit between the outer surface 34 of the bearing means 36 and the second recess 42 inner surface as provided in the lower portion 44 of the isolation tube 46. A locational slip fit is provided between the lower portion 38 of the shaft 40 and the inner race of the bearing means 36. Subsequent to this assembly, which now provides essentially a solid structure between the isolation tube 46 and the rotor 28, the assembly is inserted into the first recess 32 by a locational slip fit between it and the outer surface 34 of the bearing means 36. It can, therefore, be seen by those skilled in the art that the outer surface 34 of the bearing means 36 is utilized as the surface with respect to which the motor assembly 18 and the housing 12 are aligned. By then appropriately aligning the sleeve 16 within the housing 12 and positioning the spool 17 therein, it can be seen that the longitudinal axis of the rotor shaft 40, the drive member 22, the opening 24 and the opening 56 through which the drive member extends are all axially aligned when viewed in FIG. 1 and when the spool 17 is in its null position.

After such assembly as described above, the stator is positioned along with the cover 58 and appropriate securing mechanisms are provided in place to complete the assembly.

It should be recongnized by those skilled in the art that through the utilization of a single surface of the bearing means which supports the rotor of the motor means, a simple alignment between the torque motor and the valve housing is accomplished in a relatively simple manner and that the total locational tolerance stack-up between the rotor shaft an the valve spool is a function of the concentricity of the bearing (which is generally very small) and the tolerance on the locational fit between the drive means and the spool valve. All other tolerances such as holes for the fastening members, concentricities between the valve housing and the base of the motor housing or the like are eliminated from the effective locational tolerance stack-up. Therefore, very accurate positioning of the motor assembly 18 is accomplished with great ease and simplicity thereby reducing the cost of the rotary direct drive servovalve as well as enabling relatively simple, easy and inexpensive disassembly and reassembly after maintenance and repair thereof.

What is claimed is:

1. A direct drive servovalve comprising:

(1) a valve housing defining a bore therein;

(2) a valve spool reciprocally received within said bore for movement to control fluid flow therethrough from a supply port;

(3) motor means including a drive member for engagement with said valve spool at a predetermined point to move said valve spool in said bore; and (4) means for mounting said motor means to said valve housing comprising:

(a) bearing means for receiving and supporting said drive member and having an outer surface having a predetermined longitudinal length;

(b) said valve housing defining a first recess therein conforming to said outer surface cross-sectional configuration and having a depth less than said longitudinal length, said bearing means being received within said recess with an interference fit with a portion of said bearing means protruding from said value housing;

(c) said motor means defining a second recess therein, said protruding portion of said bearing means being received within said second recess.

2. A direct drive servovalve as defined in claim 1 wherein said bearing means is press fitted into said recess to accomplish said interference fit.

3. A direct drive servovalve as defined in claim 2 wherein said motor means is a rotary motor having stator and a rotor having said drive means extending therefrom through said housing into engagement with said spool valve, said recess being disposed with its longitudinal axis transverse the longitudinal axis of said spool valve.

* * * * *